United States Patent [19]

Ruhl

[11] 4,245,598

[45] Jan. 20, 1981

[54] SPEED CONTROL DEVICE

[76] Inventor: Hermann Ruhl, 30 Queen Elizabeth Blvd., Toronto, Ontario, Canada, M82 2T6

[21] Appl. No.: 33,971

[22] Filed: Apr. 27, 1979

[51] Int. Cl.[3] ..... F02B 77/00

[52] U.S. Cl. ..... 123/333; 123/339; 123/338; 123/387; 123/198 D; 123/198 DB

[58] Field of Search ..... 123/139 AZ, 140 A, 102, 123/198 D, 198 DB, 105

[56] References Cited

U.S. PATENT DOCUMENTS

| | | | |
|---|---|---|---|
| 3,590,798 | 7/1971 | Goodwin | 123/198 D |
| 3,661,130 | 5/1972 | Eheim | 123/140 A |
| 4,020,814 | 5/1977 | Hewitt | 123/198 DB |
| 4,178,901 | 12/1979 | Cunningham | 123/198 DB |

*Primary Examiner*—Ronald B. Cox

[57] ABSTRACT

A speed control system for controlling a vehicle's speed operates by means of limiting fuel flow to the engine of the vehicle at and above, a predetermined speed. the system comprises fuel line means to the engine, a fuel pump feeding the fuel line means, a fuel bypass from the fuel line means which is normally closed and a monitoring means for monitoring the speed of the vehicle and for opening the fuel bypass when the vehicle speed reaches or exceeds the preset speed to bypass the fuel from the fuel line means and limit fuel flow to the engine. The fuel bypass is provided with automatic pressure regulating valve means adjusted to maintain the amount of fuel flow in the fuel line means at all times for engine idling.

9 Claims, 3 Drawing Figures

SPEED CONTROL DEVICE

FIELD OF THE INVENTION

The present invention relates to a speed control system for controlling a vehicle's speed by regulating fuel flow to the engine of the vehicle.

BACKGROUND OF THE INVENTION

Over the last few years, speed limits on main thoroughways have been significantly reduced primarily as a result of fuel shortages. However, conventional engine construction permits the driving of vehicles at speeds well in excess of those called for by law, dictating the need for speed control devices such as governors on the vehicle. These are especially useful from both the fuel economy and safety standpoint on heavy-duty vehicles which are generally diesel powered.

The speed of the vehicle may be controlled by means of a device which limits or cuts off the fuel supply to the engine when a maximum preset speed is exceeded. For example, a fuel bypass line may be used in a diesel engine having a common rail line for supplying fuel to the engine from an injection pump. The fuel bypass line is closed by a valve at acceptable speeds and is only open at unacceptably high speeds. When the bypass line is open the fuel flows back to the fuel tank or into the inlet line, to the injection pump and the pressure in the common rail line is reduced so that less fuel flows to the engine.

However, the adjustment of the valve opening and closing the bypass lines presents certain operational problems. On the one hand, it is desirable to achieve maximum deceleration in which case, the dump valve to the bypass must be open to its maximum, however, the use of an uncontrolled wide open bypass has a potentially dangerous effect when the engine is idling. If the driver has exceeded the speed limit at which the uncontrolled dump valve is wide open with the accelerater pedal in the idling position as it would be for instance, when shifting gears or when declutching and disengaging the gears in an effort to increase speeds downhill, in neutral, virtually all of the fuel flows through the bypass thereby cutting off fuel flow through the common rail line to the extent that the engine stalls. Once the engine has stalled, it cannot be restarted above the preset speed limit simply because there is not enough fuel available through the rail line to the engine, nor can the gears be reengaged. Furthermore, a stalled engine deprives the vehicle of other essential auxilary power required to operate units such as the power steering and the air compressor, for the air brake system. For these, as well as other obvious reasons trying to restart the engine is a dangerous distraction for the driver when travelling at high speeds.

To overcome this difficulty, the dump valve to the bypass may be set up such that only a limited amount of fuel is dumped back to the return line to the tank or the fuel pump. This however, limits the reduction of fuel pressure in the fuel line itself, thereby taking away from the effectiveness of the bypass. For instance, when the fuel pump is set at high pressure operation required for full load and there is only limited reduction in fuel line pressure, the operator still has considerable power available from the engine and under certain conditions such as travelling with tail winds or travelling down grades, the driver is able to maintain speeds well in excess of the preset maximum.

The speed control system of the present invention provides an answer to the problems raised above, while at the same time, ensuring maximum deceleration at unacceptable high speeds. The system of the present invention comprises fuel line means to the vehicle engine, a fuel pump feeding the fuel line means, a fuel bypass which is normally closed by a speed control valve, from the fuel line means and means for monitoring the speed of the vehicle and for opening the fuel bypass when the vehicle speed reaches an unacceptable level, thereby bypassing fuel from the fuel line means and limiting fuel flow to the engine. The speed control valve in the fuel bypass opens wide at excessive speeds to provide the maximum deceleration, however, in order to avoid stalling the engine, the fuel bypass is provided with valve means adjusted to maintain the required amount of fuel flow through the fuel line means to the engine at all time for engine idling.

BRIEF DISCUSSION OF THE DRAWINGS

The above as well as other features of the present invention will be described in more detail with respect to detailed description of the preferred embodiments wherein FIG. 1 is a schematic view of a preferred speed control system according to the present invention.

DETAILED DESCRIPTION ACCORDING TO THE PREFERRED EMBODIMENTS OF THE PRESENT INVENTION

Figure 1:
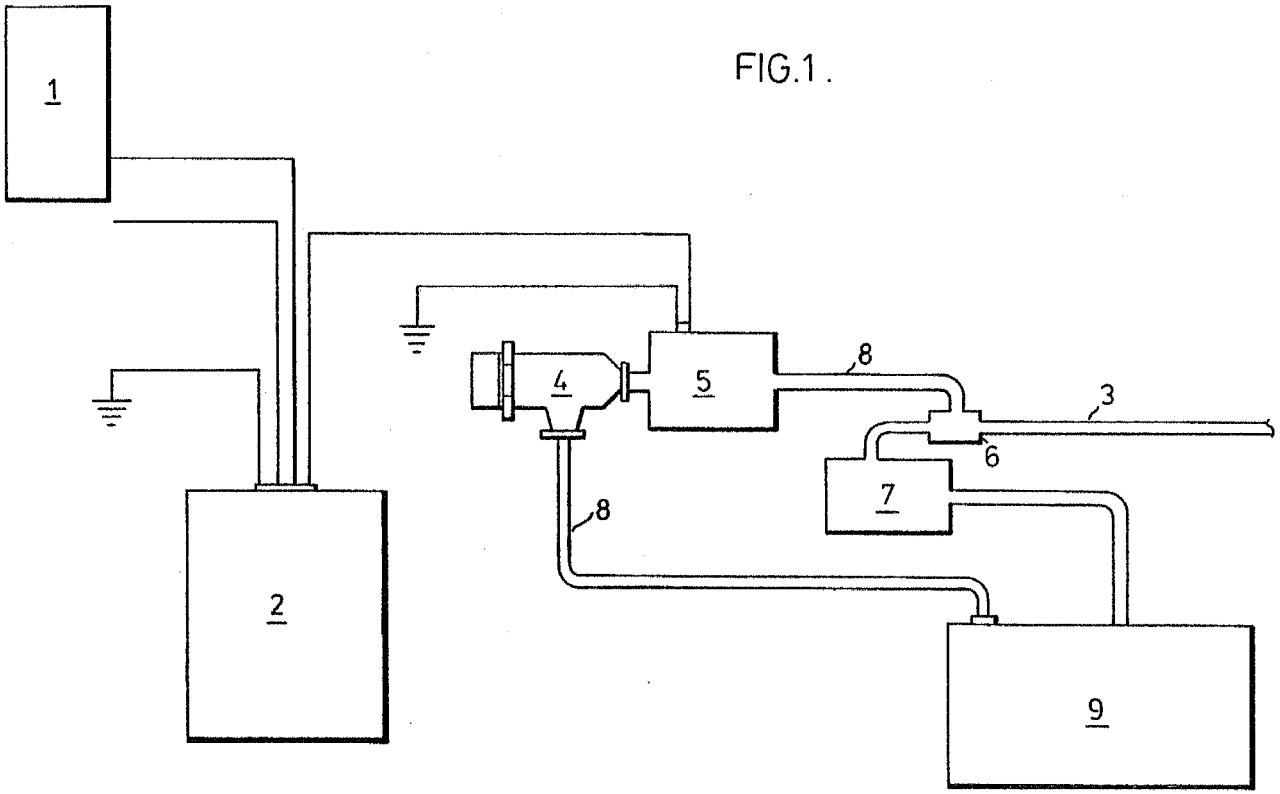

FIG. 1 shows a typical arrangement for speed control system according to the present invention. The arrangement includes a tachograph 1; power control module 2; fuel line 3; bypass line 8 joined to the fuel line at T connection 6, speed control valve 5; pressure regulating valve 4; fuel pump 7; and fuel tank 9.

When driving at acceptable speeds, fuel pump 7 functions in the standard manner and feeds fuel under pressure through the fuel rail line 3 to the injectors of the vehicle engine. However, when the speed of the vehicle reaches an unacceptable level, e.g. 100 kilometers per hour, a speed warning device provided in tachograph 1 sends a signal to power control module. This electronic power control module then causes speed control valve 5 to open in the bypass line and to dump fuel from the rail line into the bypass line and back to the fuel tank. The fuel could also be dumped back to the inlet of the fuel pump. This reduces the pressure in the fuel rail line 3 and consequently the amount of fuel passing through the injectors to the combustion chambers, thereby limiting the speed of the vehicle. It should be noted that speed control valve 5 opens wide for maximum deceleration at and above speeds of 100 kilometers per hour.

A speed control signal may also be provided to the power control module 2 by means of an electric or electronic speed sensor and a speed switch providing an electric signal to the module. Again, the module would cause the bypass system to operate when this signal is present to maintain a preset low pressure range in the rail line.

As discussed earlier, with an effective wide open bypass line and no pressure regulating valve, pressure in fuel line 3 drops to the extent that there is very little fuel flow to the injectors so that the engine may stall when idling. However, according to the present invention, this does not present a difficulty as a result of the provision of pressure regulating valve 4. After installing the bypass line with speed control valve 5 and fuel pressure regulating valve 4 in series with one another in the bypass line, the regulating valve pressure is adjusted while the engine is idling to the lowest possible rail line pressure to maintain a reliable idling speed. In other words, pressure regulating valve 4 is set to close when it senses that the rail line pressure is at the minimum required for engine idling thereby closing the bypass and ensuring that the rail line is maintained at this minimum pressure. The selection of a pressure regulating valve with sufficient flow capacity assures that the idle speed will increase only slightly when the accelerator pedal is depressed so that the fuel injection pump supplies maximum fuel quantities which would normally otherwise result in higher rail line pressures.

When the vehicle exceeds the maximum acceptable speed with the pressure regulating valve properly adjusted as described above, the fuel supply to the engine is reduced to the quantity required to maintain engine idling speed. This assures that the deceleration of the vehicle is the same as that which would occur when the driver completely releases the accelerator pedal back to the idle position. Therefore, the maximum braking effect of the engine is available however, because enough fuel is still injected to the engine to maintain idling, the engine does not stall if it is disconnected from the drive train. The excess fuel pumped by the injection pump is simply returned through bypass line 8 back to the fuel tank.

As an alternative to the use of individual flow control and control pressure rqulating valves as described above the bypass line may be provided with a combination flow control pressure regulating valve which when opened regulates, the rail line pressure to be maintained within the preset low pressure range for idling.

The system of the present invention is also operational when using a flow sensing device in lieu of a pressure sensing valve. This arrangement incorporates the use of a device sensing fuel flow through the rail line and when the device senses that the rail line fuel flow has dropped to the minimum level required for engine idling the speed control valve is closed to maintain this minimum flow in the rail line.

Further refinements can be made to the system described above. One such refinement is shown in FIG. 2 which substitutes a proportioning flow control valve for the on/off flow control valve described with respect to FIG. 1.

Figure 2:
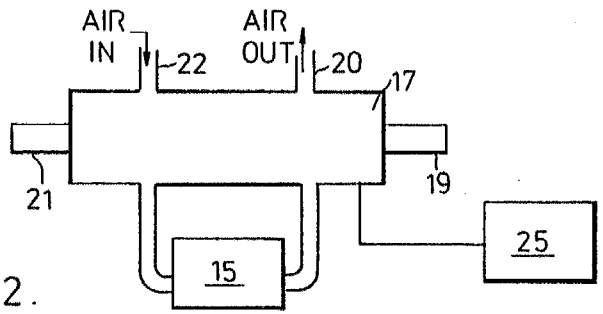
FIG. 2 is a schematic of an alternative arrangement to that shown in FIG. 1.

The arrangement of FIG. 2 is a substitution for components 4 and 5 of FIG. 1, otherwise the arrangement remains unchanged. FIG. 2 includes valve member 15, servo power control 17 having an underspeed coil 19, an overspeed coil 21, an air outlet 20 and an air inlet 22.

The proportioning flow control valve arrangement regulates the fuel supply in relation to the difference of the actual speed of the vehicle against a preset speed level. The valve functions by means of a speed control unit 25 which evaluates the information received from the speed sensor and compares this information with that corresponding to the preset speed level. The speed control unit provides an output proportional to the speed difference between the actual driving speed and the preset speed level. This proportional output is then compared in a signal comparator with a feedback signal indicative of the flow control valve position. If the valve is not in the proper position, it is activated by the servo power unit which in turn is controlled by a solenoid operated servo power control valve. The signal comparator sends a control signal into the underspeed coil of the servo power control valve if the speed of the vehicle has fallen from an unacceptable level to an acceptable level. This causes the servo power control valve to supply corresponding air pressure to the servo power unit to close the flow control valve and increase the rail line pressure to provide more power to the engine. If on the other hand, the vehicle's speed has climbed from an acceptable level to an unacceptable level, a signal is sent to the overspeed coil to direct air pressure to the servo power unit to open the flow control valve thereby, reducing the rail line pressure and subsequent engine power.

The system shown in FIG. 2 operates as a cruise control, and in a situation where the vehicle is travelling at a very slight excessive speed, e.g. 101 kilometers per hour, and the speed is increased to a greater excessive speed, a further signal is sent to the overspeed coil to direct more air pressure to the servo power unit to further open the flow control valve. Therefore this control valve is a proportioning valve as opposed to the abrupt on/off valve described with respect to FIG. 1.

The speed control unit could also be operted to provide a continuous output signal when the vehicle is travelling at acceptable speeds. When the vehicle reaches an unacceptable speed this electrical output signal is then interrupted to open the flow control valve.

In addition, the system may include a visible or audible warning signal for the driver which is actuated by a change in output signal from the system. According to this arrangement a delay circuit is included in the line to the flow control valve which maintains a signal indicative of an acceptable speed for preset time span to allow the driver to reduce the speed before the automatic speed control is activated.

Figure 3:
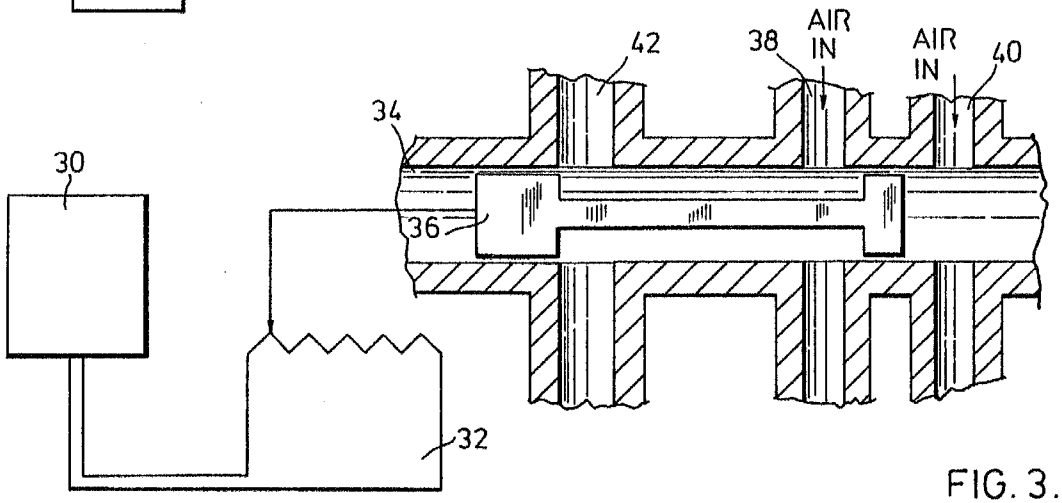
FIG. 3 is a schematic of a further refinement of the arrangement shown in FIG. 2.

FIG. 3 shows the specific arrangement of a servo power control for operating a flow control valve such as that described with respect to FIG. 2. This arrangement includes a speed control unit 30, a feedback 32, a flow control valve 34, having a valve plunger 36, air inlet 36, air inlet 38 and an air inlet 40 and a hydraulic dump line or fuel bypass 42.

The arrangement of FIG. 3 operates by means of a speed control unit providing a speed difference signal which is directed to feedback 32. The flow control valve is also connected to feedback 32 to indicate the position of valve plunger 36. The signal comparator in the feedback compares the speed difference signal with the feedback from the flow control valve to indicate the position of valve plunger 36. A servo power control similar to that shown in FIG. 2 is connected to the servo power flow control valve and the signal comparator causes the output from the servo power control to open the flow control valve if the speed difference signal is greater than the feedback signal from the flow control valve and to close the flow control valve if the speed difference signal is less than the feedback signal.

FIG. 3 shows the hydraulic dump line at maximum opening, e.g. extreme excessive speeds. If however, the speed of the vehicle drops, a speed difference signal from control unit 30 is fed into the feedback 32. This signal is compared with the feedback signal from the flow control valve indicating the position of valve plunger 36. The underspeed coil is then operated to force air into the flow control valve through inlet 38 to close valve plunger 36 accordingly. The amount of closure in the valve is determined in accordance with the decrease in the vehicle's speed. If the valve plunger has moved to the closed position and the vehicle's speed is again increased, the overspeed coil is operated to force air in through inlet 40 to again open the valve plunger.

Although various preferred embodiments of the invention have been described herein in detail, it will be apparent to those skilled in the art that variations may be made thereto without departing from the spirit of the invention or the scope of the appended claims.

The embodiment of the invention in which an exclusive property or privilege is claimed are defined as follows:

1. A speed control system for controlling a vehicle's speed by means of limiting fuel flow to the engine of the vehicle at a predetermined speed, said system comprising fuel line means to the engine, a fuel pump for pumping fuel through said fuel line means, a fuel bypass from the fuel line means, said fuel bypass being normally closed and only being opened at unacceptable speeds to bypass some of the fuel away from the engine whereby there is only a limited remaining fuel flow through the fuel line means to the engine and monitoring means for monitoring the speed of the vehicle and for opening the fuel bypass when the vehicle reaches said predetermined speed, said fuel bypass being provided with fuel flow regulating valve means responsive to the remaining fuel flow through the fuel line means to the engine to maintain said remaining fuel flow at a preselected rate for a desired engine idling R.P.M.

2. A speed control system for controlling a vehicle's speed by means of limiting fuel flow to the engine of the vehicle at a predetermined speed, said system comprising fuel line means to the engine, a fuel pump for pumping fuel through said fuel line means, a fuel bypass from the fuel line means which is normally closed and which is only opened at unacceptable speeds to bypass some of the fuel away from the engine such that there is only a limited remaining fuel flow through the fuel line means to the engine, and monitoring means for monitoring the speed of the vehicle and for opening the fuel bypass when the vehicle reaches said predetermined speed, said fuel bypass being provided with automatic fuel flow regulating valve means responsive to pressure of the limited remaining fuel flow through the fuel line means to the engine to maintain said remaining fuel flow at a preselected rate for a desired engine idling R.P.M.

3. A speed control system for combustion engines for controlling a vehicle's speed by limiting fuel flow to the engine of the vehicle at a predetermined speed through regulation of fuel pressure in a common rail line from a controllable fuel injection pump to the fuel injectors of the engine, said system comprising in combination, a speed sensor sending speed depending signals, to a speed control unit providing an output signal depending on the difference between a preset speed level and the speed sensed by the speed sensor, a hydraulic dump line which is normally closed and which only opens at unacceptable speeds for dumping some of the fuel from the common rail line and away from the engine, said dump line being provided with a servo valve responding to the output signal of the speed control unit and a pressure regulating valve in series with the servo valve for keeping the rail line pressure from falling below a preset narrow pressure range for offsetting the effect of higher or lower fuel supply from the injection pump.

4. A speed control system as claimed in claim 3, including an electric or electronic speed sensor, a speed switch providing an electric signal when predetermined speed is exceeded, a flow control valve responsive to the signal of the speed switch, for opening the dump line when the signal is present and a pressure regulating valve adjusted to maintain the rail line pressure at a preset low pressure range when the flow control valve is open.

5. A speed control system as defined in claim 4, having a combination flow control pressure regulating valve which when opened, regulates the rail line pressure to said preset pressure range.

6. A speed control system as defined in claim 3, wherein the speed control unit provides an electrical output signal when speeds are below the predetermined speed, the electrical output signal being interrupted when the vehicle reaches the predetermined speed, the flow control valve being closed when the signal is present and being opened when the signal is interrupted.

7. A speed control system as defined in claim 3, wherein the speed control unit provides a change of output signal at the predetermined speed and including a visible or audible warning signal for the driver actuated by the change of output signal and a delay circuit in the line to the flow control valve which maintains the signal condition existing below the predetermined speed for a preset time span to permit the driver to reduce his speed prior to the opening of the flow control valve.

8. A speed control system as defined in claim 3, wherein the speed control unit provides a speed difference signal output depending on the difference between the predetermined speed and the speed sensed by the speed sensor, the servo power flow control valve being controlled by the speed difference signal and being closed when said speed difference signal indicates speeds less than said predetermined speed and being opened in relation to increasing positive speed difference signals to permit correspondingly increased flow therethrough.

9. A speed control system as defined in claim 3, wherein said speed control unit provides a speed difference signal and including a signal feedback unit connected to the flow control valve, a signal comparator comparing the speed difference signal with the feedback signal from the flow control valve and a servo power control connected to the servo powered control valve, said signal comparator causing the servo power output from the servo power control to the flow control valve to open the flow control valve if the speed difference signal is greater than the feedback signal from the flow control valve and to close the flow control valve, if the speed difference signal is less than the feedback signal.

* * * * *